US005553710A

United States Patent [19]

Takama

[11] Patent Number: 5,553,710

[45] Date of Patent: Sep. 10, 1996

[54] ARTICLE STORING TRAY CONVENIENT FOR VARIOUS PARTITIONING

[75] Inventor: Yukio Takama, Sabac, Japan

[73] Assignee: Sakase Chemical Industry Co., Ltd, Fukui-ken, Japan

[21] Appl. No.: 339,893

[22] Filed: Nov. 14, 1994

Related U.S. Application Data

[63] Continuation-in-part of Ser. No. 871,051, Apr. 20, 1992, abandoned.

[30] Foreign Application Priority Data

Apr. 22, 1991 [JP] Japan ..... 3-90831

[51] Int. Cl.[6] ..... B65D 1/34; B65D 1/36

[52] U.S. Cl. ..... 206/561; 220/533

[58] Field of Search ..... 206/557, 561; 220/552, 529, 532, 533, 530

[56] References Cited

U.S. PATENT DOCUMENTS

| | | | |
|---|---|---|---|
| 3,200,983 | 8/1965 | Walter | 220/533 |
| 3,581,906 | 6/1971 | Joyce | 220/532 X |
| 4,261,464 | 4/1981 | Maitland | 220/533 X |
| 4,838,445 | 6/1989 | Lanius | 220/533 |
| 4,884,689 | 12/1989 | Su-Chin | 220/533 X |
| 5,054,668 | 10/1991 | Ricchiuti | 220/533 X |
| 5,215,205 | 6/1993 | Behlman | 220/533 X |
| 5,427,446 | 6/1995 | Glomski | 220/533 X |

FOREIGN PATENT DOCUMENTS

| | | | |
|---|---|---|---|
| 115493 | 10/1969 | Denmark | 220/533 |
| 9002055 | 4/1992 | Netherlands | 220/533 |
| 418254 | 2/1967 | Switzerland | 220/532 |

*Primary Examiner*—B. Dayoan
*Attorney, Agent, or Firm*—Staas & Halsey

[57] ABSTRACT

An article storing tray convenient for various partitioning includes a tray. The tray has a tray body having a plurality of drop-in dovetail grooves and also has at least one comb-toothed partition board having a plurality of through dovetail grooves with dovetail tenons at opposite ends of the partition board. With this configuration, the partition board can be dovetailed in two drop-in dovetail grooves of the tray body. The tray further has at least one sub-partition board having dovetail tenons at opposite ends of the sub-partition board so that the sub-partition board can be dovetailed in any of the drop-in dovetail grooves of the tray body and any of the through dovetail grooves to the comb-toothed partition board. In such a tray, by dovetailing the comb-toothed partition boards and the sub-partition boards in the dovetail grooves, the internal space of the tray body can be divided into a variety of compartments and these partition boards can be securely held.

5 Claims, 8 Drawing Sheets

ARTICLE STORING TRAY CONVENIENT FOR VARIOUS PARTITIONING

This application is a continuation-in-part, of application Ser. No. 07/871,051, filed on Apr. 20, 1992, now abandoned.

BACKGROUND OF THE INVENTION

1. Field of the Invention

The present invention relates to a tray for use in office work and medical treatment, and more particularly to a tray for classifying and storing articles by arranging partition boards as desired.

2. Description of the Related Art

In the field of medical treatment in which various kinds of medical appliances and medicines are used, the medical appliances and medicines are classified, maintained and stored by arranging partition boards in an internal space of a tray. In this ease, division by arranging partition boards requires great versatility because the medical appliances and medicines have various sizes. Thus, attempts for increasing versatility of division have been made. For example, there are methods for slidably mounting the partition boards or fitting the partition boards in a desired part of multistage grooves. Also, such a tray is used in the field of office work.

However, the method for slidably mounting the partition boards has the disadvantage that the partition boards tend to slide easily, and the method for fitting the partition boards in the grooves has the disadvantage that if a large external force is applied to the partition boards, the partition boards slip out of the grooves and thus classification of the articles stored in the tray gets out of order. It is possible to prevent the partition boards from sliding or slipping out by reducing the play between the partition board and the groove in order to increase the friction force between the parts fitting together. However, if the play between the partition board and the groove is too small, it is very difficult to insert or remove the partition boards and dividing the internal space of the tray becomes troublesome.

SUMMARY OF THE INVENTION

Accordingly, it is an object of the present invention is to provide a tray for storing articles convenient for various partition configuration wherein an internal space of the tray for classification or storage can be freely divided lengthwise and breadthwise using partition boards and the partition boards can be securely held in place.

In the tray for storing the articles according to the present invention, a dovetail joint method is employed for attaching dovetail tenons formed at both ends of the partition board to dovetail grooves. The direction for detailing this dovetail joint is an upward direction (away from the bottom of the tray). The force applied in use of the tray is less in this direction, so that the partition board can be smoothly removed while being subject to little frictional resistance and then joined to other parts as necessity requires. By adopting the dovetail joint method, the tray of the present invention has more advantages than a conventional tray in that the partition boards, once attached via the dovetail joint, rarely slide or slip off in use.

It is another object of the present invention to provide a tray for storing articles wherein by employing a comb-toothed partition board in which comb-shaped grooves are formed in the entire partition board, the entire comb-toothed partition board is not subject to large bending because only the comb-toothed part to which an external force is applied is subject to bending. This is true even if the external force is locally applied directly to a comb of this comb-toothed-partition board. Also such a comb-toothed partition board can provide higher flexibility than a partition board having no comb-shaped grooves, and by using the comb-toothed partition board having high flexibility, the entire partition board can be bent thus providing an internal space of the tray divided into curved compartments.

It is a further object of the present invention is to provide a tray for storing articles wherein, by employing a comb-toothed partition board with grooves having a through structure (space between teeth), the thickness of the comb-toothed partition board can be less than that of a normal partition board with grooves having no through structure, so that the capacity of the tray can be more effectively utilized, and also flexibility of the partition board can be improved.

Therefore, by using the above partition boards, a plurality of the partition boards are successively joined and the internal space of the tray is divided into various shapes, and thus versatility of division remarkably increases and a conveniently dividable tray for storing the articles can be obtained.

DETAILED DESCRIPTION OF THE INVENTION

Figure 1:
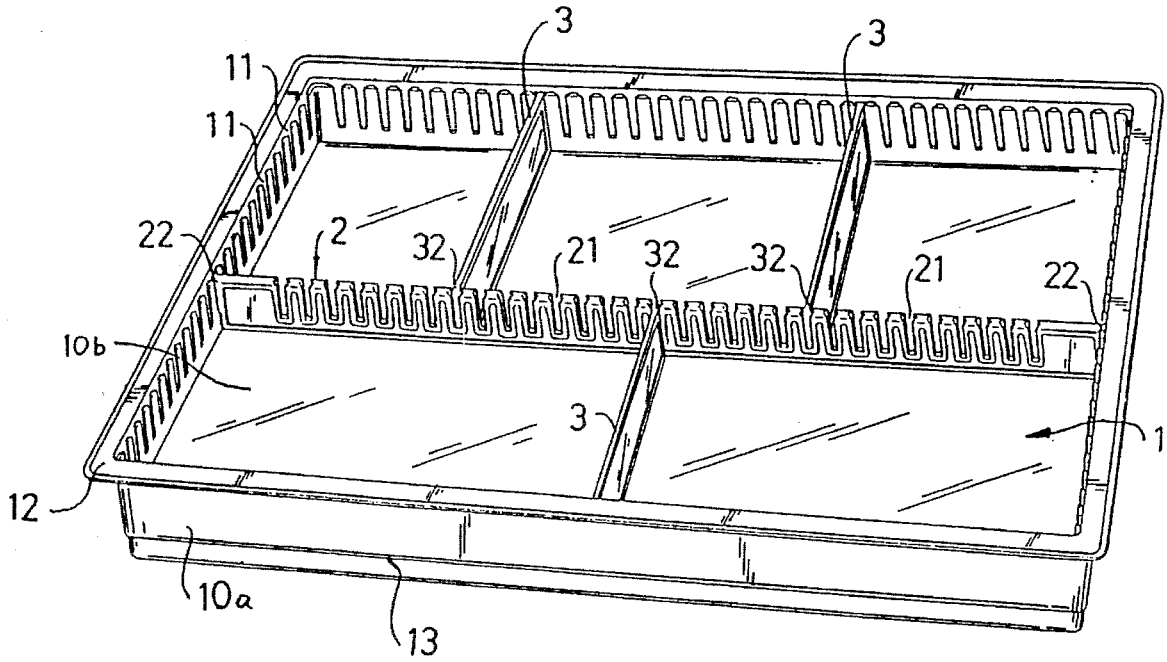
FIG. 1 is a perspective view of a tray of an embodiment according to the present invention.

The present invention will be described below by way of embodiments with reference to the accompanying drawings.

In the drawings, numeral 1 designates a tray body with a substantially rectangular parallelopiped shape surrounded by standing sidewalls and comprising a base **10*b* and opposing sidewalls 10*a*, upwardly projecting from four sides of the base 10*b*. This tray body 1 may be obtained by an injection molding method. Each inner surface of these sidewalls 10*a* is provided with a plurality of drop-in dovetail grooves 11 having a predetermined depth, at regular intervals, and each drop-in dovetail groove 11** is capable of accommodating a dovetail tenon of a partition board. This "drop-in" dovetail groove is a dovetail groove which has a joint structure capable of dropping a dovetail tenon therein from an upward direction.

Figure 8:
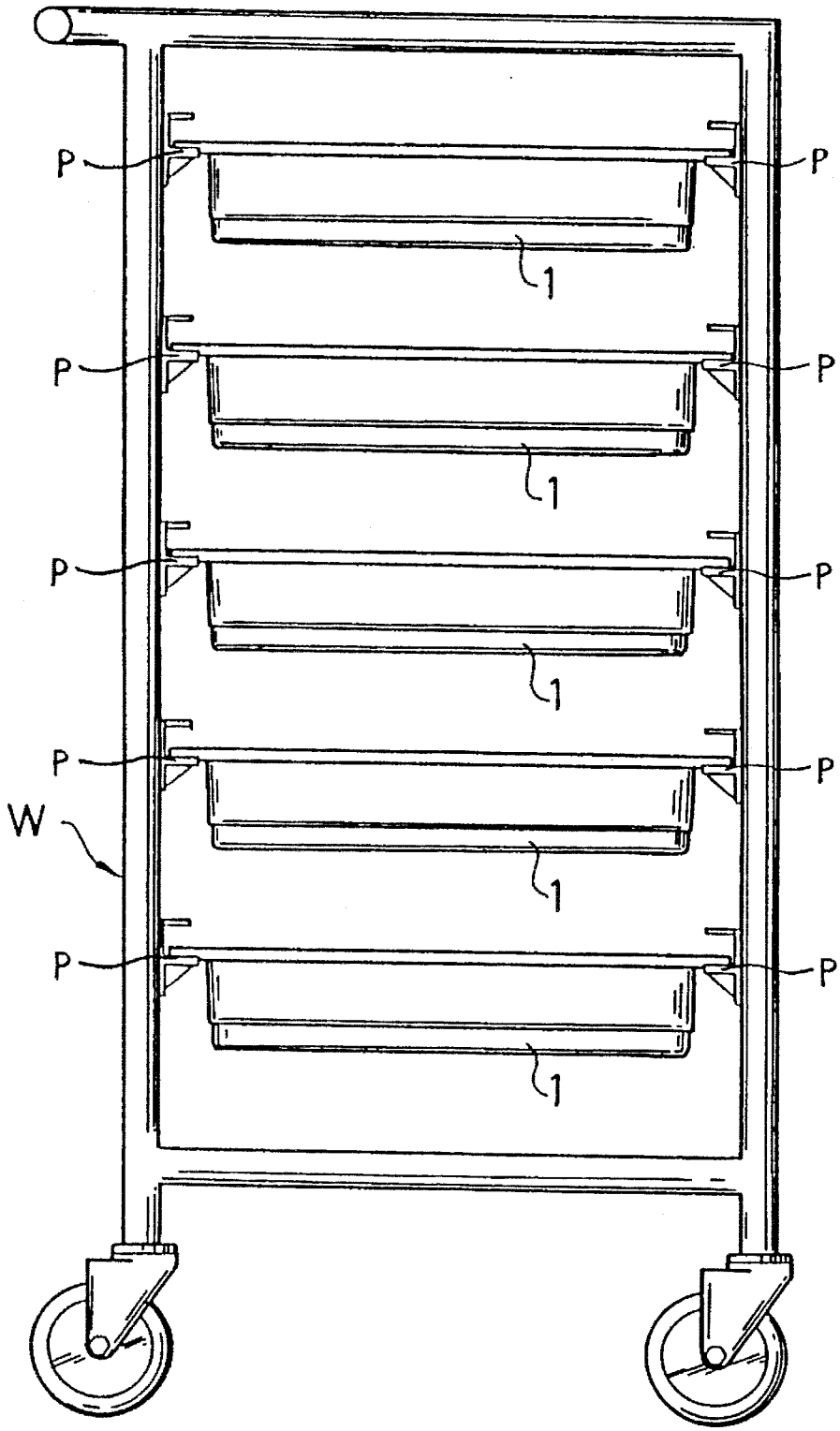
FIG. 8 is an illustration showing an example of an embodiment in which a plurality of trays are stored in a wagon.

The top edge of each sidewall 10*a* of the tray body 1 is provided with a flange 12 extending in an outer direction. By slidably placing this flange 12 on a predetermined storage device (for example, protruding parts P of a wagon W as shown in FIG. 8), a plurality of the tray bodies 1 can be carried simultaneously. Any device having a shape capable of placing the flange 12 thereon may be used as the storage device, and further the storage device may be formed on a desk for office work or a rack as well as the wagon W.

Figure 7:
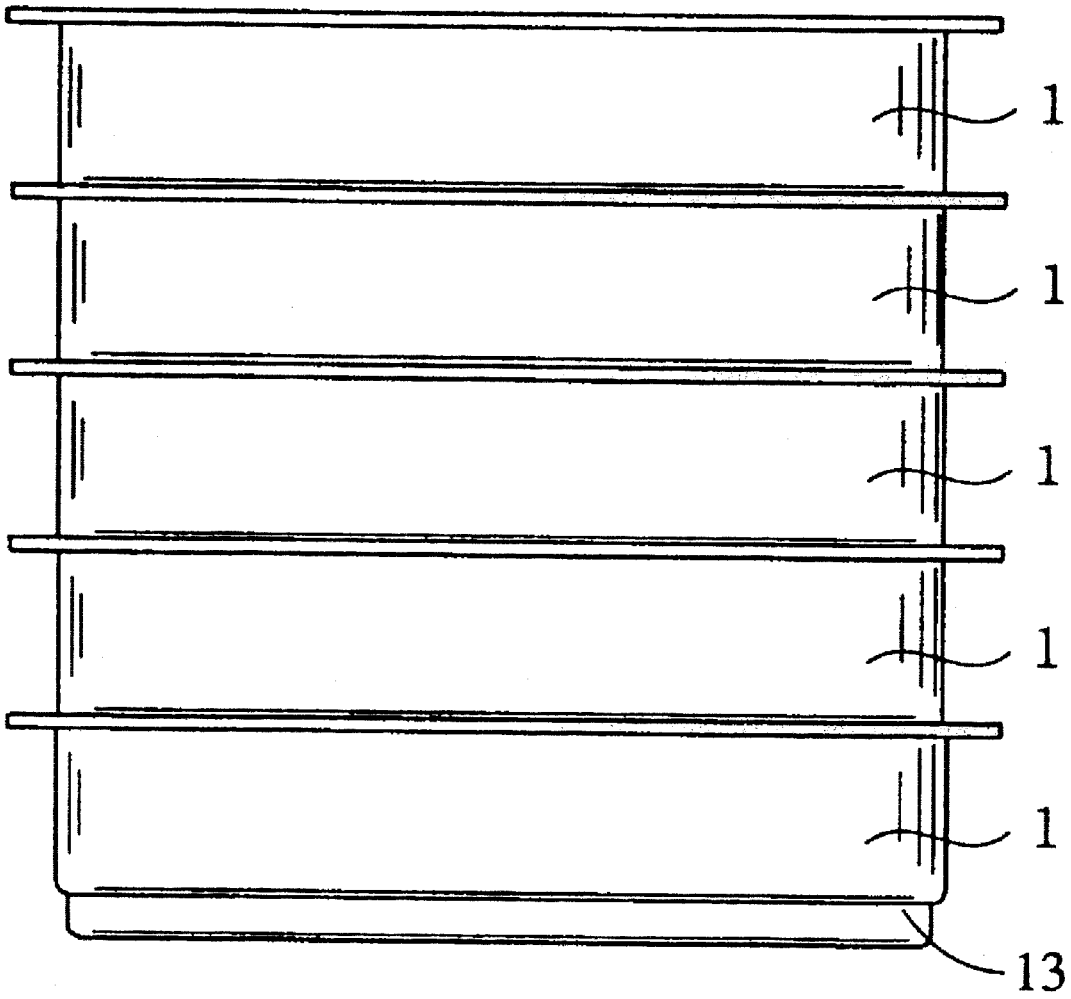
FIG. 7 is an illustration showing an example of an embodiment in which a plurality of trays are directly stacked.

A step 13 in which the diameter of the tray is decreased is formed in the lower portion of the outside on each sidewall 10*a* of the tray body 1. The outer diameter of the lower portion is equal to an inner diameter of the top edge of the tray body 1, so that a plurality of the tray bodies 1 can be directly stacked as shown in FIG. 7.

Figure 2:
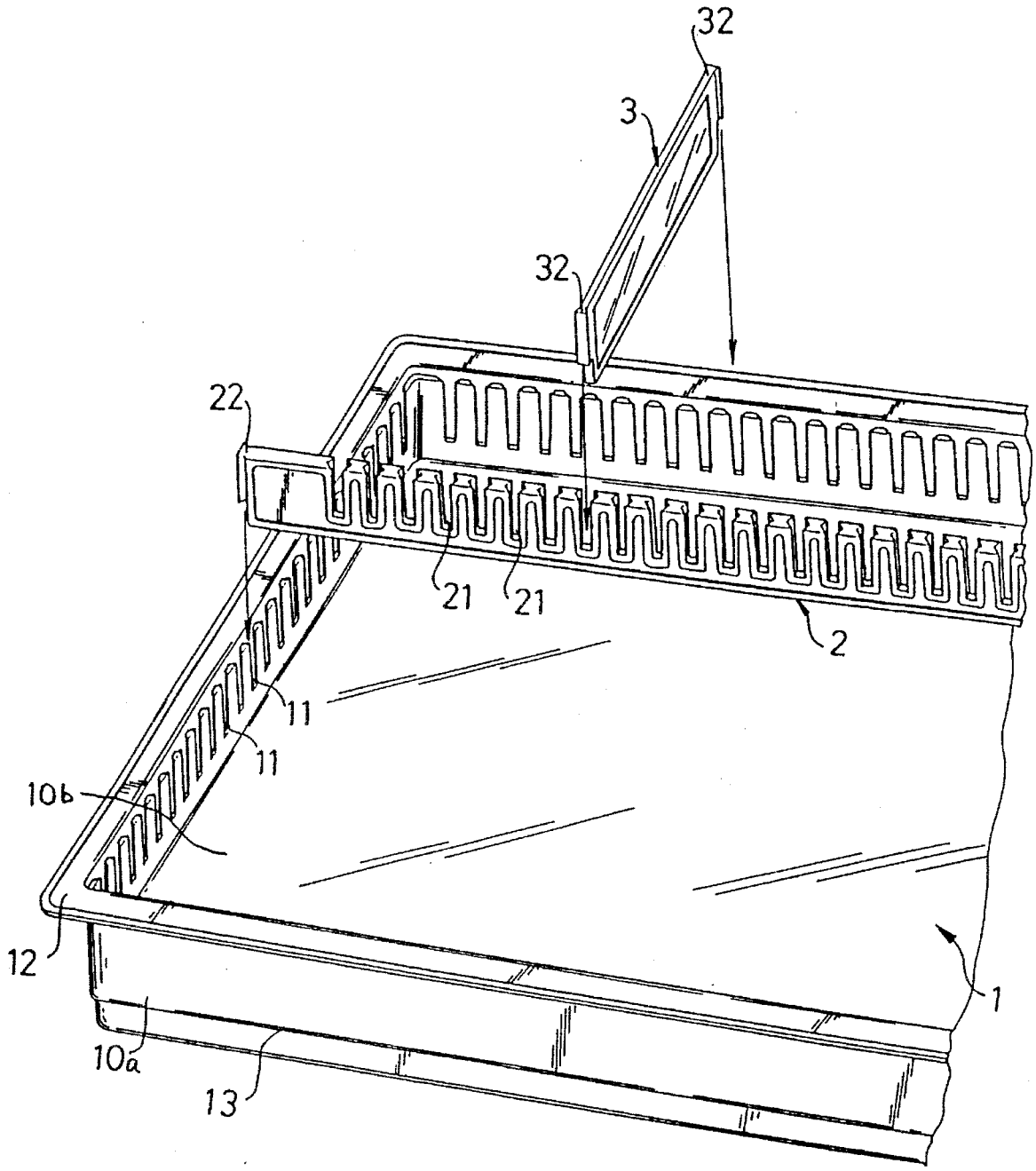
FIG. 2 is an exploded perspective view showing a part of the tray of the embodiment.
Figure 3:
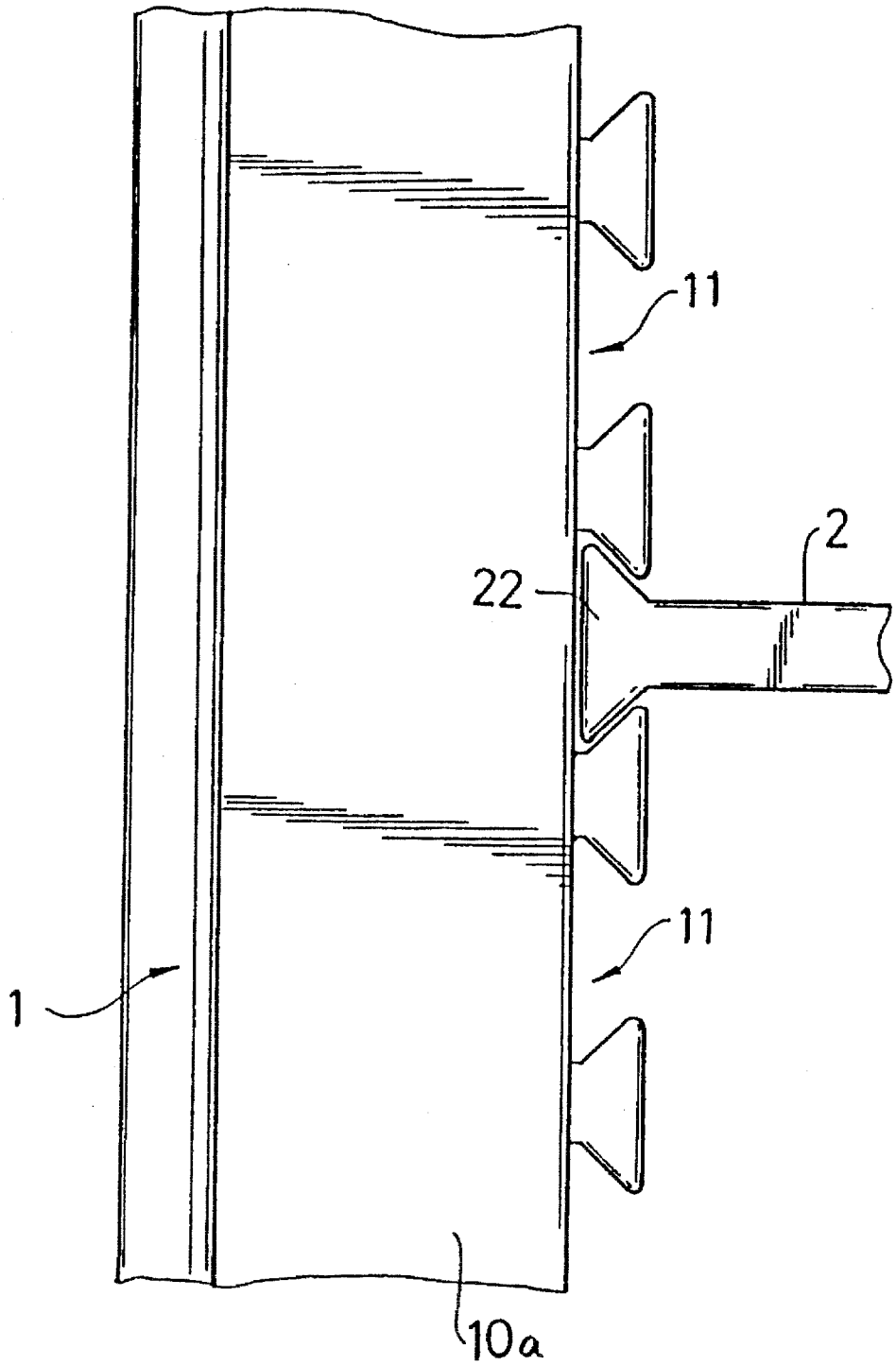
FIG. 3 is a partially enlarged plan view showing a dovetail joint structure between a dovetail groove of a sidewall and a dovetail tenon of a comb-toothed partition board in the tray of the embodiment.

Next, numeral 2 designates a comb-toothed partition board for dividing the internal space of the tray body 1. The comb-toothed partition board is provided with a plurality of through dovetail grooves 21 having the same depth as the drop-in dovetail grooves 11 of the tray body 1. This "through" dovetail groove is a dovetail groove having a through structure in which openings extend through the partition board in the board thickness direction at required intervals. Like the tray body 1, this comb-toothed partition board 2 may be obtained by the injection molding method. The comb-toothed partition board 2 has a length sufficient to enable the partition board 2 to extend between two opposing drop-in dovetail grooves 11 of the tray body 1, and has dovetail tenons 22 and 22 at opposite ends so that the partition board 2 can be dovetailed in the opposing drop-in dovetail grooves 11 of the tray body 1. As shown in FIGS. 2 and 3, when these dovetail tenons 22 of the comb-toothed partition board 2 are dovetailed in the two opposing drop-in dovetail grooves 11 of the tray body 1 in a drop-in manner, the partition board 2 can be smoothly fitted therein while being subject to little frictional resistance and the internal space of the tray body 1 can be divided according to a desired ratio. Also, by employing such a comb-toothed partition board 2, the entire comb-toothed partition board 2 is not subject to large bending because only the comb-toothed part to which an external force is applied is subject to bending. This is true even if the external force is applied directly to a part of the comb-toothed partition board 2 while using of the tray for storing articles.

Figure 4:
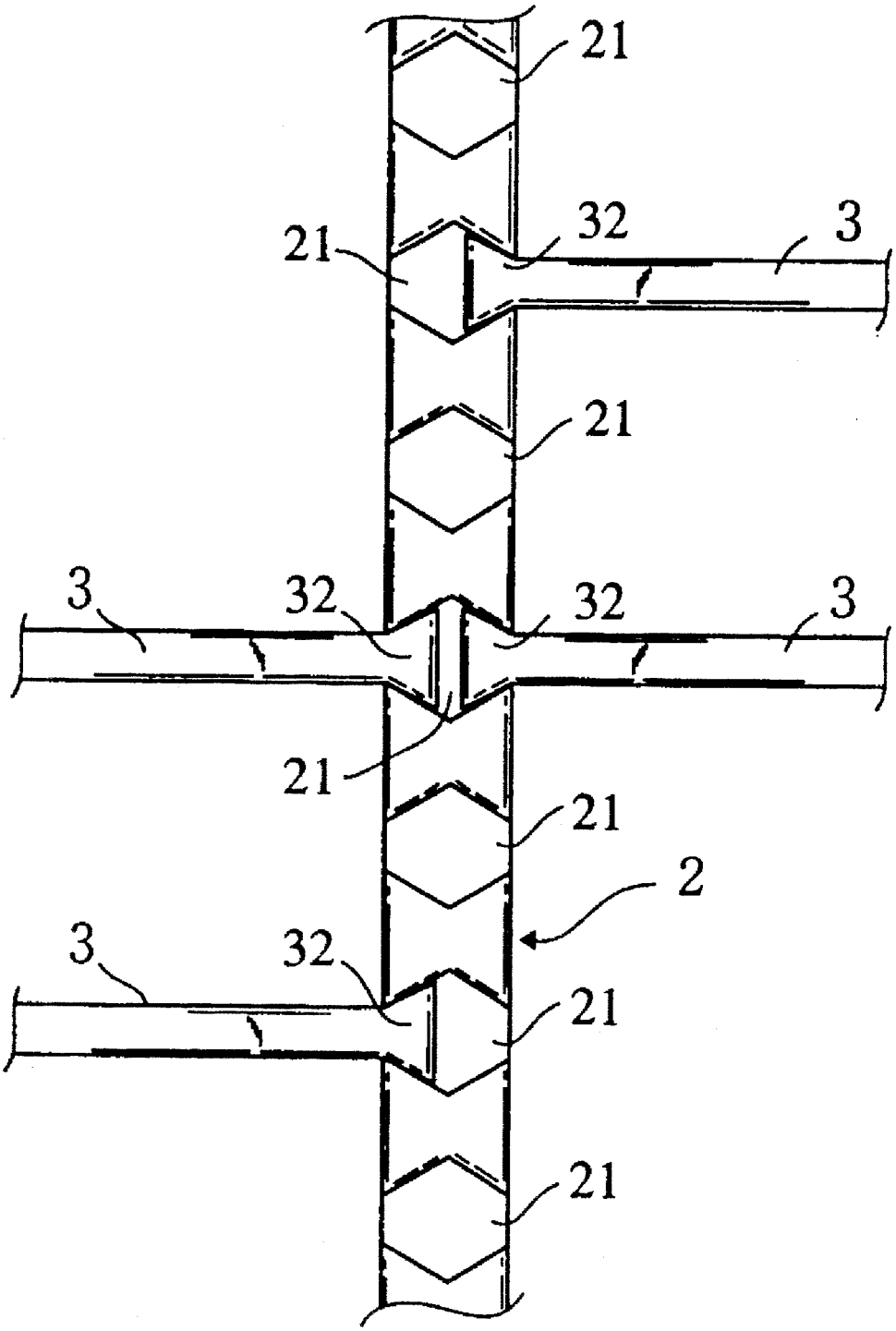
FIG. 4 is a partially enlarged plan view showing a dovetail joint structure between dovetail grooves of a comb-toothed partition board and dovetail tenons of sub-partition boards in the tray of the embodiment.
Figure 5:
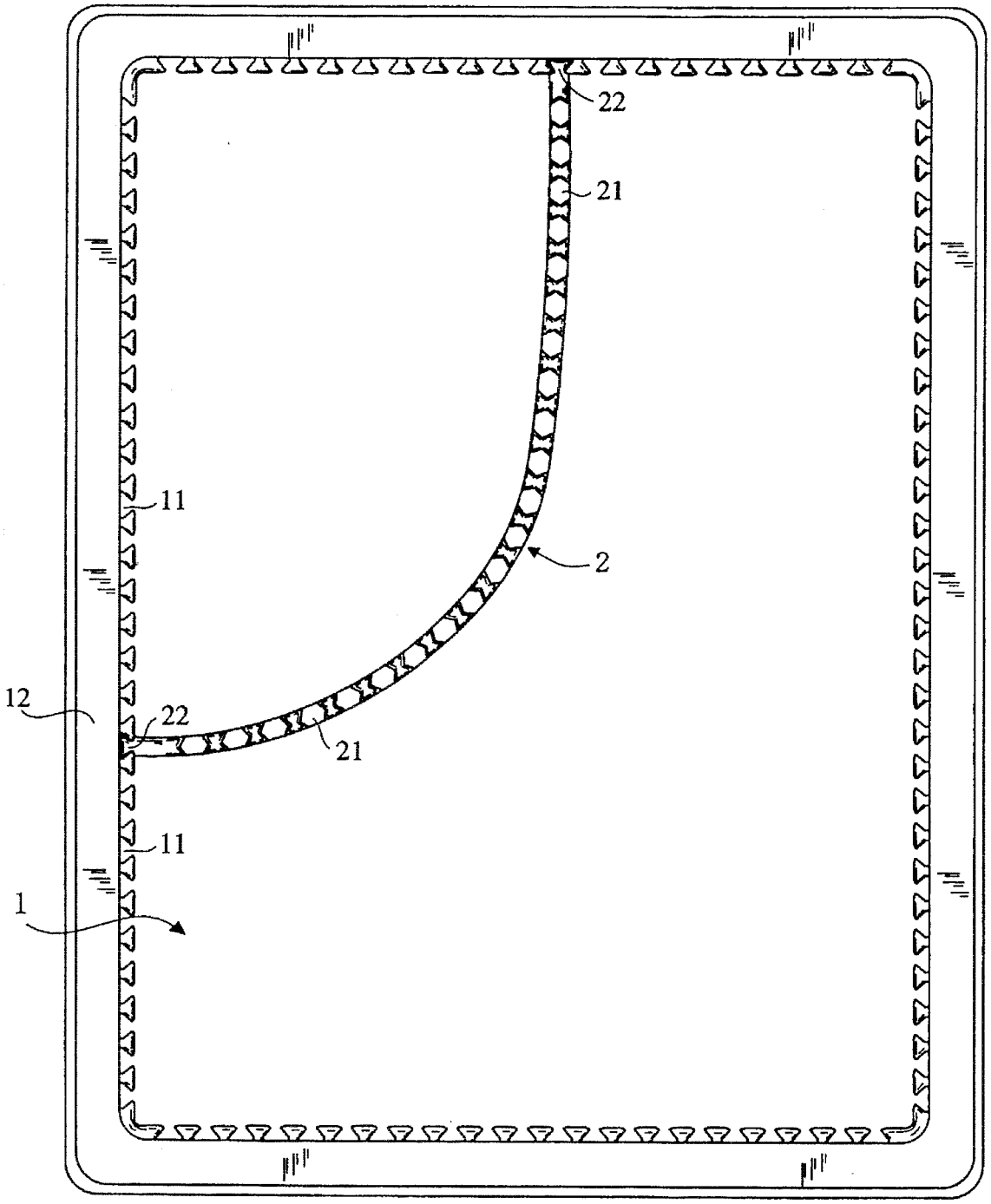
FIG. 5 is a plan view of a tray of another embodiment in which an internal space of the tray is divided by bending a comb-toothed partition board in an arc shape.
Figure 6:
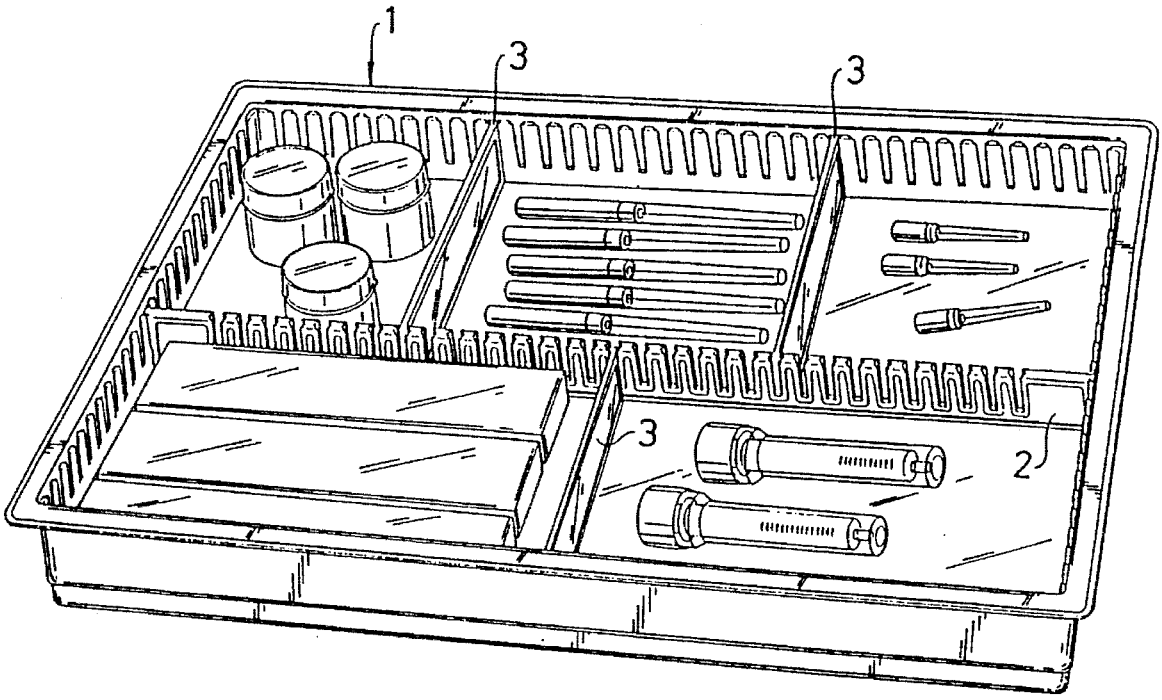
FIG. 6 is an illustration showing use of the tray of an embodiment according to the present invention.

As shown in FIG. 4, each through dovetail groove 21 formed in the comb-toothed partition board 2 is capable of accommodating the two dovetail tenons with longitudinal sides of the dovetail tenons facing each other. In previous dovetail grooves capable of accommodating two dovetail tenons, generally, the thickness of the partition board increases by the thickness of a boundary layer part formed in the middle of the dovetail groove. However, because each through dovetail groove 21 of the comb-toothed partition board 2 is formed with the through structure, the partition board 2 does not have the boundary layer part. As a result, the thickness of the partition board 2 can be reduced by the thickness of the boundary layer part and the capacity of the tray can be more effectively utilized. Further, because each through dovetail groove 21 is closely spaced, the comb-toothed partition board 2 has good flexibility and thus the internal space of the tray body 1 can be divided into curved compartments by bending the entire partition board 2 as shown in FIG. 5. As a material of the comb-toothed partition board 2, plastics having high elasticity such as a vinyl chloride resin may be adopted and by using the plastics, flexibility of the comb-toothed partition board 2 can be more improved.

Furthermore, numeral 3 designates a sub-partition board for subdividing the internal space of the tray body 1. Sub-partition board 3 has dovetail tenons 32 at opposite ends therefore. These dovetail tenons 32 of the sub-partition board 3 can be dovetailed in any of the drop-in dovetail grooves 11 of the tray body 1 and dovetail in the through dovetail grooves 21 of the comb-toothed partition board 2. The sub-partition board 3 can extend between a drop-in dovetail groove 11 of the tray body 1 and the through dovetail groove 21 of the comb-toothed partition board 2 or between two comb-toothed partition boards 2 and can be fitted from the upward direction. The sub-partition board 3 can be formed in a desired length and a plurality of the sub-partition boards 3 with various lengths are provided. Thus, even if the comb-toothed partition boards 2 are fitted in different drop-in dovetail grooves 11 of the tray body 1, the internal space of the tray body 1 can still be subdivided using a sub-partition board 3 having a length equal to the distance to be fitted.

Also, because the comb-toothed partition board 2, in which the dovetail tenon 32 of the sub-partition board 3 are dove tailed is provided with the through dovetail grooves 21 extending therethrough in the board thickness direction, a contacting area between the dovetail tenon 32 and the through dovetail groove 21 is small, and as a result, the coefficient of friction is very low when the sub-partition board 3 is fitted in or pulled out. Therefore, even if the sub-partition board 3 is upwardly pulled out in a hurry, the comb-toothed partition board 2 will not be raised together with the sub-partition board 3.

In the tray for storing the articles constructed in the above manner, a dovetail joint method is employed for attaching each partition board, the tray using a plurality of the partition boards having good flexibility. In this manner the tray body 1, the comb-toothed partition boards 2 and the sub-partition boards 3 can be mutually joined in a very stable state. Further, using these partition boards, the internal space of the tray body 1 can be divided into a variety of sizes and shapes and thus versatility of division remarkably increases. Accordingly, a conveniently divided tray for storing the articles can be obtained.

What is claimed is:

1. An article storing tray convenient for various partitioning, comprising:

a tray body comprising a base having four sides, and opposing sidewalls extending upwardly from the four sides of the base, the base and side walls defining an internal space, each sidewall being provided with a plurality of drop-in dovetail grooves having a predetermined depth, each drop-in dovetail groove having a shape capable of accommodating a dovetail tenon;

at least one comb-toothed partition board having opposite ends with dovetail tenons at the opposite ends so that the partition board can be dovetailed in two of the drop-in dovetail grooves of the tray body, each comb-toothed partition board being provided with a plurality of through dovetail grooves extending completely through the comb-toothed partition board in the direction of board thickness, the through dovetail grooves having the same depth as the drop-in dovetail grooves of the tray body, each through dovetail groove having a shape capable of simultaneously accommodating two dovetail tenons with longitudinal sides of the dovetail tenons facing each other, the through dovetail grooves providing flexibility to the comb-toothed partition board; and at least one sub-partition board having opposite ends with dovetail tenons at the opposite ends so that the sub-partition board can be dovetailed in any of the drop-in dovetail grooves of the tray body and can be dovetailed in any of the through dovetail grooves of the comb-toothed partition board, whereby the internal space of the tray body can be divided into various shapes by the at least one flexible comb-toothed partition board.

2. An article storing tray convenient for various partitioning, comprising:

a tray body comprising a base having four sides, and two pairs of opposing sidewalls extending upwardly from the four sides of the base, the base and side wails defining an internal space, each sidewall being provided with a plurality of drop-in dovetail grooves having a predetermined depth, each drop-in dovetail groove having a shape capable of accommodating a dovetail tenon;

at least one comb-toothed partition board having opposite ends, having a length sufficient to enable the partition board to extend between opposing drop-in dovetail grooves of at least one pair of the two pairs of opposing side wails of the tray body, and having dovetail tenons at the opposite ends so that the partition board can be dovetailed in one drop-in dovetail groove of each side wall between which the partition board is enabled to extend, each comb-toothed partition board being provided with a plurality of through dovetail grooves extending completely through the comb-toothed partition board in the direction of board thickness, the through dovetail grooves having the same depth as the drop-in dovetail grooves of the tray body, each through dovetail groove having a shape capable of simultaneously accommodating two dovetail tenons with longitudinal sides of the dovetail tenons facing each other, the through dovetail grooves providing flexibility to the comb-toothed partition board; and at least one sub-partition board having opposite ends with dovetail tenons at the opposite ends so that the sub-partition board can be dovetailed in any of the drop-in dovetail grooves of the tray body and can be dovetailed in any of the through dovetail grooves of the comb-toothed partition board, whereby the internal space of the tray body can be divided into various shapes by the at least one flexible comb-toothed partition board.

3. A tray as claimed in claim 1, wherein a plastic having high elasticity is used as a material of the comb-toothed partition board.

4. A tray as claimed in claim 1, wherein a step is formed in a lower outside portion of each sidewall of the tray body so that a lower portion of a first tray body can be stacked on a top edge of a second tray body.

5. A tray as claimed in claim 1, wherein each sidewall of the tray body has a top edge provided with a flange extending in an outer direction, the flange having a width allowing the tray body to be slidably stored in a predetermined storage device.

* * * * *